US005498648A

United States Patent [19]

de Clercq et al.

[11] Patent Number: 5,498,648

[45] Date of Patent: Mar. 12, 1996

[54] PAPER SIZE MIXTURES

[75] Inventors: Arnold de Clercq, Dirmstein; Roland Ettl, Hassloch; Carlos A. Goncalves, Ludwigshafen; Lothar Hoehr, Worms; Andreas Hohmann, Ludwigshafen; Ulrich Riebeling, Schifferstadt, all of Germany

[73] Assignee: BASF Aktiengesellschaft, Ludwigshafen, Germany

[21] Appl. No.: 393,001

[22] PCT Filed: Aug. 23, 1993

[86] PCT No.: PCT/EP93/02259

§ 371 Date: Mar. 1, 1995

§ 102(e) Date: Mar. 1, 1995

[87] PCT Pub. No.: WO94/05855

PCT Pub. Date: Mar. 17, 1994

[30] Foreign Application Priority Data

Sep. 1, 1992 [DE] Germany ..... 42 29 142.9

[51] Int. Cl.[6] ..... C08L 3/00; C08L 89/00; C09D 4/00

[52] U.S. Cl. ..... 524/47; 524/827; 524/832; 106/210; 106/213; 106/287.2; 62/158

[58] Field of Search ..... 524/47, 827, 832; 106/210, 213, 287.2; 162/158; 62/158

[56] References Cited

U.S. PATENT DOCUMENTS

| | | | |
|---|---|---|---|
| 484,429 | 10/1892 | Holland . | |
| 3,006,806 | 10/1961 | Schlir | 162/158 |
| 3,130,118 | 4/1964 | Chapman | 162/175 |
| 4,243,481 | 1/1981 | Dumas | 524/607 |
| 4,317,756 | 3/1982 | Dumas | 524/607 |
| 4,434,269 | 2/1984 | Probst et al. | 524/538 |
| 4,659,437 | 4/1987 | Probst | 162/168.2 |
| 4,855,343 | 8/1989 | Degen et al. | 524/47 |
| 5,154,763 | 10/1992 | Ksoll et al. | 106/287.2 |

FOREIGN PATENT DOCUMENTS

| | | | |
|---|---|---|---|
| 150003 | of 0000 | European Pat. Off. . | |
| 267770 | 10/1892 | European Pat. Off. . | |
| 51144 | 9/1981 | European Pat. Off. . | |
| 58313 | 2/1984 | European Pat. Off. . | |
| 257412 | 8/1989 | European Pat. Off. | 524/147 |
| 0353212 | 1/1990 | European Pat. Off. . | |
| 3000502 | 1/1981 | Germany . | |
| 3235529 | 9/1982 | Germany . | |
| 3316179 | 4/1983 | Germany . | |

OTHER PUBLICATIONS

Japanese Laid–Open Application No. J58/115,196, Dec. 26, 1981.

*Primary Examiner*—Paul R. Michl
*Assistant Examiner*—LaVonda R. DeWitt
*Attorney, Agent, or Firm*—Oblon, Spivak, McClelland, Maier & Neustadt

[57] ABSTRACT

Paper size mixtures which are prepared by mixing an aqueous suspension of a digested cationic starch with a finely divided, aqueous polymer dispersion which is the paper size and emulsifying the $C_{14}$–$C_{22}$-alkyldiketene in this mixture at not less than 70° C. are used for engine and surface sizing of the paper.

5 Claims, No Drawings

PAPER SIZE MIXTURES

The present invention relates to paper size mixtures comprising $C_{14}$–$C_{22}$-alkyldiketene emulsions and finely divided, aqueous polymer dispersions having a sizing effect, and to the use of the paper size mixtures as engine and surface sizes for paper.

U.S. Pat. No. 3,130,118 discloses that alkyldiketenes having at least 6 carbon atoms in the molecule can be emulsified in water in the presence of cationic starch. The resulting alkyldiketene emulsions having a relatively low concentration are used as engine sizes for paper. Papers engine sized with these emulsions develop the full sizing effect not directly after the paper drying process but only after the paper has been stored for one or more days at room temperature. However, sizes which develop the full sizing effect immediately after drying of the sized paper are required in practice.

DE-A-3 000 502 discloses that aqueous emulsions of fatty alkyldiketenes mixed with cationic condensates can be used as sizes. Examples of suitable cationic condensates are epichlorohydrin-crosslinked reaction products of condensate of dicyanodiamide or cyanamide and a bisaminopropylpiperazine or condensates of epichlorohydrin and bisaminopropylpiperazine. The cationic condensates result in accelerated development of the sizing effect of fatty alkyldiketenes but possess the disadvantage that they have an adverse effect on the whiteness of the paper.

DE-A-3 316 179 discloses that emulsions of fatty alkyldiketenes together with polyethyleneimines and/or water-soluble condensates based on water-soluble polyamidoamines grafted with ethyleneimine and then crosslinked with epichlorohydrin can be used as sizes for paper. Even when these size mixtures are used, the diketene sizing effect develops within a short time. However, the cationic size accelerators for fatty alkyldiketenes are very sensitive to interfering substances which accumulate during the papermaking process in the paper mills, owing to the partially or completely closed water circulation. They also have an adverse effect on the whiteness of the paper.

EP-A-0 437 764 discloses stabilized aqueous alkyldiketene emulsions which may contain up to 40% by weight of an alkyldiketene in an emulsified form and which contain long-chain fatty esters and/or urethanes as stabilizers.

JP-A-58/115 196 discloses a paper assistant which increases the strength of paper and at the same time sizes the paper. This paper assistant is based on a dispersion of a graft copolymer of styrene with alkyl acrylates on starch. The graft copolymers are obtained by polymerizing styrene and an acrylate in an aqueous medium at from 20° to 100° C. with formation of an aqueous dispersion.

EP-B-0 257 412 and EP-B-0 267 770 disclose paper sizes based on finely divided, aqueous dispersions of copolymers which are obtainable by copolymerizing (a) from 20 to 65% by weight of acrylonitrile and/or methacrylonitrile, (b) from 80 to 35% by weight of an acrylate of a monohydric, saturated $C_3$–$C_8$-alcohol and (c) from 0 to 10% by weight of other monoethylenically unsaturated copolymerizable monomers by an emulsion polymerization method in an aqueous solution which contains a degraded starch, in the presence of initiators containing peroxide groups. The degraded starches have viscosities $\eta_i$ of 0.04–0.50 dl/g.

EP-B-0 051 144 discloses finely divided, aqueous polymer dispersions which are a paper size and are prepared by a 2-stage polymerization. In the first stage of polymerization, a low molecular weight prepolymer of a nitrogen-containing monomer, a nonionic, hydrophobic ethylenically unsaturated monomer and an ethylenically unsaturated carboxylic acid or maleic anhydride is first prepared. This prepolymer serves as a protective colloid for the subsequent second stage of polymerization, in which nonionic hydrophobic ethylenically unsaturated monomers are polymerized by an emulsion polymerization method in the presence of conventional amounts of water-soluble polymerization initiators.

EP-A-0 058 313 and EP-A-0 150 003 disclose cationic paper sizes which are obtained by copolymerizing acrylonitrile and acrylates and/or methacrylates or monomer mixtures of styrene, acrylates and/or methacrylates and, if required, acrylonitrile and/or methacrylonitrile in an aqueous solution of a cationic copolymer as an emulsifier. The cationic emulsifier is a terpolymer of N,N-dimethylaminoethyl acrylate and/or methacrylate, styrene and acrylonitrile.

When used as sizes, the finely divided, aqueous polymer dispersions described above have an excellent immediate sizing effect, that the required amounts for complete sizing of the paper are considerably higher than in the case of sizes which consist of fatty alkyldiketene emulsions or contain fatty alkyldiketenes in emulsion form.

DE-A-3 235 529 discloses paper size mixtures which consist of emulsions of $C_{14}$–$C_{20}$-dialkylketenes and polymer dispersions which contain finely divided, nitrogen-containing monomers as polymerized units and are disclosed in the abovementioned EP-B-0 051 144. These size mixtures are prepared by combining a fatty alkyldiketene emulsion with the aqueous finely divided polymer dispersion or are formed in the paper stock itself prior to sheet formation, by adding the emulsified fatty alkyldiketene and the finely divided aqueous dispersion simultaneously to the paper stock and thoroughly mixing the system. Simple mixtures of fatty alkyldiketene emulsions and the cationic finely divided aqueous polymer dispersions do not have a sufficiently long shelf life.

It is an object of the present invention to provide an improved paper size which contains fatty alkyldiketenes and, when used as an engine size, results in an adequate immediate sizing effect and does not adversely affect the whiteness of the paper.

We have found that this object is achieved, according to the invention, by paper size mixtures if they are prepared by mixing an aqueous suspension of a digested cationic starch with a finely divided, aqueous polymer dispersion which is a paper size and emulsifying a $C_{14}$–$C_{20}$-alkyldiketene in this mixture at not less than 70° C. Emulsification of the alkyldiketenes may additionally be reflected in the presence of fatty esters and urethanes, which are stabilizers for alkyldiketene emulsions.

Alkyldiketenes are known and are commercially available. They are prepared, for example, from the corresponding acyl chlorides by eliminating hydrogen chloride with tertiary amines.

The fatty alkyldiketenes are, for example of the formula

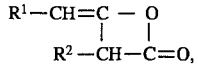

where $R^1$ and $R^2$ are each $C_4$–$C_{20}$-alkyl.

To prepare paper size mixtures according to the invention, the alkyldiketenes described above or mixtures thereof are emulsified in a mixture which consists of an aqueous suspension of a digested cationic starch and finely divided aqueous polymer dispersions which are usually used alone as paper sizes. Suitable cationic starches are commercially available, usually used as a protective colloid for emulsifying alkyldiketenes and disclosed, for example, in the abovementioned U.S. Pat. No. 3,130,118. From 1 to 20, preferably from 2 to 7, % by weight, based on fatty alkyldiketenes, of protective colloid, preferably cationic starch, are usually required.

To prepare particularly highly concentrated alkyldiketene emulsions in the mixture of starch and finely divided, aqueous polymer dispersions which are paper sizes, the emulsification of the alkyldiketenes is additionally carried out in the presence of stabilizers. Suitable stabilizers are disclosed in EP-A-0 437 764. These are, for example, esters of the formula

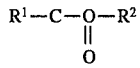

(I)

where (1) $R^1$ and $R^2$ are each $C_{14}$–$C_{22}$-alkyl, $R^1$ and $R^2$ differing by at least 4 carbon atoms in the alkyl chain, (2) $R^1$ is $C_{14-C22}$-alkyl and $R^2$ is $C_{14}$–$C_{22}$-alkenyl, (3) $R^1$ is $C_{14-C22}$-alkenyl and $R^2$ is $C_{14}$–$C_{22}$-alkyl or (4) $R^1$ and $R^2$ are identical or different $C_{14}$–$C_{22}$-alkenyl radicals.

The compounds of the formula I are known. Examples of suitable compounds of the formula I where $R^1$ and $R^2$ have the meanings stated above under (1) are behenyl stearate, stearyl behenate, stearyl myristate, behenyl myristate, behenyl palmitate and isododecyl stearate.

Other suitable stabilizers are compounds of the formula $R^3$—O—CO—$R^4$ (II). $R^3$ and $R^4$ are identical or different alkyl or alkenyl radicals, at least one of the substituents $R^3$ and $R^4$ being of not less than 6 carbon atoms. These substituents may contain from 2 to 22 carbon atoms. If $R^3$ and $R^4$ are each alkenyl, the alkenyl group is preferably of not less than 6 carbon atoms. Examples of compounds of the formula II are oleyl stearyl carbonate, behenyl oleyl carbonate, ethyl oleyl carbonate, dioleyl carbonate, behenyl stearyl carbonate and 2-hexyldecyl oleyl carbonate.

The compounds of the formula

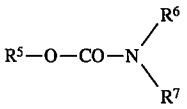

(III)

are also known substances. $R^5$, $R^6$ and $R^7$ are identical or different. They may be of 2 to 22 carbon atoms and are each alkyl or alkenyl, at least one of the substituents $R^5$, $R^6$ and $R^7$ containing not less than 12 carbon atoms. If these substituents are alkenyl, the number of carbon atoms of the alkenyl groups is in general at least 12. Examples of compounds of the formula III are oleyl-N,N-distearylurethane, palmityl-N, N-distearylurethane, oleyl-N-palmityl-N-stearylurethane and behenyl-N,N-distearylurethane.

The stabilizers are used in amounts of from 0.1 to 20, preferably from 3 to 6, % by weight, based on fatty alkyldiketenes.

Finely divided, aqueous polymer dispersions which are a paper size are disclosed in, for example, EP-B-0 051 144, EP-B-0 257 412, EP-B-0 276 770, EP-B-0 058 313 and EP-B-0 150 003. Such polymer dispersions which act as paper sizes are obtainable, for example, by copolymerizing from 1 to 32 parts by weight of a mixture of (a) styrene, acrylonitrile and/or methacrylonitrile, (b) acrylates and/or methacrylates of $C_1$–$C_{18}$-alcohols and/or vinyl esters of saturated $C_2$–$C_4$-carboxylic acids, with or without (c) other monoethylenically unsaturated copolymerizable monomers in aqueous solution in the presence of 1 part by weight of a solution copolymer of (1) di-$C_1$–$C_4$-alkylamino-$C_2$–$C_4$-alkyl (meth)acrylates which may be protonated or quaternized, (2) nonionic, hydrophobic, ethylenically unsaturated monomers, these monomers forming hydrophobic polymers when polymerized alone, with or without (3) monoethylenically unsaturated $C_3$–$C_5$-carboxylic acids or anhydrides thereof, the molar ratio of (1):(2):(3) being 1:2.5 to 10:0 to 1.5.

A solution copolymer is first prepared by copolymerizing the monomers of groups (1) and (2) and, if required, (3) in a water-miscible organic solvent. Examples of suitable solvents are $C_1$–$C_3$-carboxylic acids, such as formic acid, acetic acid and propionic acid, or $C_1$–$C_4$-alcohols, such as methanol, ethanol, n-propanol or isopropanol, and ketones, such as acetone. Dimethylaminoethyl acrylate, dimethylaminoethyl methacrylate, dimethylaminopropyl methacrylate and dimethylaminopropyl acrylate are preferably used as monomers of group (1). The monomers of group (1) are preferably used in protonated or quaternized form. Suitable quaternizing agents are, for example, methyl chloride, dimethyl sulfate or benzyl chloride.

Nonionic, hydrophobic, ethylenically unsaturated compounds which form hydrophobic polymers when polymerized alone are used as monomers of group (2). These include, for example, styrene, methylstyrene, $C_1$–$C_{18}$-alkyl esters of acrylic acid or methacrylic acid, for example methyl acrylate, ethyl acrylate, n-propyl acrylate, isopropyl acrylate, n-butyl acrylate, tert-butyl acrylate and isobutyl acrylate, as well as isobutyl methacrylate, n-butyl methacrylate and tert-butyl methacrylate. Acrylonitrile, methacrylonitrile, vinyl acetate, vinyl propionate and vinyl butyrate are also suitable. It is also possible to use mixtures of the monomers of group 2 in the copolymerization, for example mixtures of styrene and isobutyl acrylate. The solution copolymers serving as an emulsifier may furthermore contain polymerized monomers of group (3), for example monoethylenically unsaturated $C_3$–$C_5$-carboxylic acids or anhydrides thereof, eg. acrylic acid, methacrylic acid itaconic acid, maleic acid, maleic anhydride or itaconic anhydride. The molar ratio of (1):(2):(3) is 1:2.5 to 10:0 to 1.5. The copolymer solutions thus obtained are diluted with water and, in this form, serve as protective colloids for the polymerization of the abovementioned monomer mixtures of components (a) and (b) and, if required, (c). Suitable monomers of group (a) are styrene, acrylonitrile, methacrylonitrile or mixtures of styrene and acrylonitrile or of styrene and methacrylonitrile. Acrylates and/or methacrylates of $C_1$–$C_{18}$-alcohols and/or vinyl esters of saturated $C_1$–$C_{18}$-carboxylic acids are used as monomers of group (b). This group of monomers corresponds to the monomers of group (2), which has already been described above. Butyl acrylate and butyl methacrylate, eg. isobutyl acrylate, n-butyl acrylate and isobutyl methacrylate, are preferably used as monomers of group (b). Monomers of group (c) are, for example, monoethylenically unsaturated $C_3$–$C_5$-carboxylic acids, acrylamidomethylpropanesulfonic acid, sodium vinylsulfonate, vinylimidazole, N-vinylformamide, acrylamide, methacrylamide and N-vinylimidazoline. From 1 to 32 parts by weight of a monomer mixture of the components (a) to (c) are used per part by weight of the copolymer. The monomers of component (a) and (b) can be copolymerized in any ratio, for example in a molar ratio of from 0.1:1 to 1:0.1.

The monomers of group (c) are, if required, used for modifying the properties of the copolymers.

The finely divided, aqueous dispersions described as paper sizes disclosed in EP-0 257 412 and EP-B-0 276 770 are preferably used. These dispersions are prepared by copolymerizing (a) from 20 to 65% by weight of styrene, acrylonitrile and/or methacrylonitrile, (b) from 80 to 35% by weight of acrylates and/or meth acrylates of monohydric saturated $C_3$–$C_8$-alcohols and (c) from 0 to 10% by weight of other monoethylenically unsaturated copolymerizable monomers in the presence of free radical initiators by an emulsion polymerization method in an aqueous solution of a degraded starch as a protective colloid. The degraded starch preferably has a viscosity $\eta_i$ of from 0.04 to 0.50 dl/g. These starches have been subjected to an oxidative, thermal, azidolytic or enzymatic degradation. All natural starches, for example starches from potatoes, wheat, rice, tapioca and corn, may be used for this degradation. Chemically modified starches, such as starches containing hydroxyethyl, hydroxypropyl or quaternized aminoalkyl groups and having viscosities in the abovementioned range may also be used. Oxidatively degraded potato starches, cationic, degraded potato starches or hydroxyethylstarch are particularly suitable. The mixture of the copolymer dispersions having a sizing effect and of an undigested starch is preferably stirred for at least 10 minutes at 85° C. This results in digestion of the starch.

The degraded starches act as emulsifiers in the copolymerization of the monomers (a) to (c) in an aqueous medium by an emulsion polymerization method. The monomers are copolymerized in an aqueous solution which contains from 1 to 21, preferably from 3 to 15, % by weight of degraded starch. From 10 to 140, preferably from 40 to 100, parts by weight of the monomer mixture of (a) and (b) and, if required, (c) are usually polymerized in 100 parts by weight of such a solution. The diameter of the dispersed polymer particles is from 50 to 350 nm, preferably from 100 to 250 nm. Other suitable monomers of group (b) are vinyl esters of $C_2$–$C_4$-saturated carboxylic acids. Examples of suitable monomers of group (c) are acrylamide, methacrylamide, stearyl acrylate, stearyl methacrylate, palmityl acrylate, acrylic acid, methacrylic acid, maleic acid, maleic anhydride, itaconic acid, vinylsulfonic acid, acrylamidopropanesulfonic acid and acrylates and methacrylates of amino alcohols, eg. dimethylaminoethyl acrylate, dimethylaminoethyl methacrylate, dimethylaminopropyl acrylate and dimethylaminopropyl methacrylate.

The novel paper size mixtures are prepared by first mixing an aqueous suspension of a digested cationic starch with at least one of the abovementioned finely divided, aqueous polymer dispersions which is the paper size. For example, it is possible to start from a 0.5–5% strength by weight aqueous suspension of a cationic starch, which is converted into a water-soluble form in a known manner, for example by heating to the glutinization temperature or by heating in the presence of an acid, eg. sulfuric acid. The aqueous solution obtained is then mixed with the finely divided aqueous polymer dispersion or with a mixture of such dispersions and is heated to at least 70° C. The temperature of the mixture can be increased to the boiling point of the mixture. $C_{14}$–$C_{22}$-Alkyldiketenes are then emulsified in the mixture of digested cationic starch and finely divided aqueous polymer suspension, said mixture having been heated to at least 70° C. The alkyldiketenes are metered in molten form into the mixture of digested starch and aqueous polymer dispersions and are emulsified under the action of shear forces, for example in a homogenizer which operates according to the high pressure let-down principle.

According to the invention, size mixtures having a particularly long shelf life are obtained when the solid fatty alkyldiketene and one of the abovementioned stabilizers, eg. behenyl stearate or oleyl behenate, are mixed and are added in the form of a melt to a finely divided, aqueous polymer dispersion which has been heated to 75°–95° C., is a paper size and contains a digested cationic starch, and this mixture is homogenized under the action of shear forces. After the homogenization step, the resulting paper size mixture is cooled to ambient temperature. The pH of the alkyldiketene emulsion/polymer dispersion mixture is usually from 2.0 to 4.0, preferably 3.0. In the preparation of this mixture, further assistants, such as ligninsulfonate, formalin or propionic acid, may also be added.

The prepared paper size mixtures contain from 10 to 80, preferably from 30 to 60, % by weight of fatty alkyldiketenes and from 20 to 90, preferably from 30 to 70, % by weight of finely divided, aqueous polymer dispersions, based in each case on the solids. The paper size mixtures described above are used as engine and surface sizes for paper, the use as engine size being preferred. For this purpose, the aqueous polymer size mixtures are diluted to concentrations of from 0.08 to 0.5% by weight, based on alkyldiketene, by adding water.

The novel paper size mixtures have a long shelf life, whereas mixtures which are obtained merely by combining finely divided aqueous polymer dispersions which are paper sizes with emulsions of fatty alkyldiketenes which have been emulsified with the aid of digested cationic starch as the protective colloid do not have sufficient stability. The last-mentioned mixtures either tend to separate or become solid after storage for a short time, for example after 8 days, and can then no longer be used for the intended purpose.

In the Examples which follow, parts are by weight and percentages are based in each case on the weight of the emulsions prepared. They have been chosen so that the added amount of alkyldiketene is constant, based on absolutely dry stock.

The degree of sizing of the papers was determined with the aid of the Cobb value according to DIN 53,132. The following stock model was used for testing the sizing effect:

100% bleached birch sulfate pulp having a freeness of 35° SR (Schopper-Riegler), 40% of chalk, and, as a retention aid, 0.025% of a high molecular weight polyacrylamide Occasionally, 1% by weight of a cationic starch is added to the paper.

For immediate sizing, the sheets are dried on a steam-heated drying cylinder at 90° C. to a residual moisture content of 10–15%; the test for the final sizing is carried out 1 day after preparation of the sheets and drying at 90° C. to a residual moisture content of about 6% and subsequent storage at 23° C. at a relative humidity of 50%.

The papers prepared have a basis weight of 80 g/m$^2$ and an ash content of about 17%.

The whiteness of the papers was determined according to DIN 53,145.

In the Examples, the following finely divided aqueous polymer dispersions, which are usually used as paper sizes, were employed:

Polymer dispersion 1

In a 1 l four-necked flask equipped with a stirrer, a reflux condenser, a metering apparatus and a means for working under a nitrogen atmosphere, 34.0 g of starch A and 8.4 g of starch B are suspended in 148 g of water and heated to 85° C. while stirring.

Starch A is a degraded cationic potato starch having a viscosity $\eta_i$ of 0.47 dl/g, a degree of substitution of 0.015 —COOH and 0.027 N mol/mol of glucose units and a solids content of 83%.

Starch B is a degraded, cationic potato starch having a viscosity $\eta_i$ of 1.16, a degree of substitution of 0.07N mol/mol of glucose units and a solids content of 83%.

After 30 minutes at 85° C., 2.6 g of an aqueous 10% strength calcium acetate solution and 10 g of a 1% strength enzyme solution (α-amylase A) are added. After a further 20 minutes at 85° C., the enzymatic starch degradation is terminated by adding 1.5 g of glacial acetic acid. Thereafter, 16.5 g of a 1% strength iron(II) sulfate solution and 1.75 g of 30% strength hydrogen peroxide are added. After 20 minutes, the hydrogen peroxide has decomposed and the oxidative starch degradation is complete. The intrinsic viscosity of the starch mixture is then 0.08 dl/g. 1.8 g of 30% strength hydrogen peroxide are then added and, beginning immediately, an emulsion which consists of 93.7 g of acrylonitrile, 76.4 g of n-butyl acrylate and a solution of 0.2 g of Na $C_{14}$-alkylsulfonate in 50 g of water is added uniformly in the course of 1 hour and, simultaneously but separately therefrom, 50 g of a 3.12% strength hydrogen peroxide solution are introduced in the course of 1.75 hours. During this time and also 60 minutes after the end of the monomer metering, the temperature of the reaction mixture is kept at 85° C. A dispersion having a solids content of 41.0% and a particle diameter (without starch covering) of 100–150 run is obtained. The dispersion is diluted to a solids content of 33% by adding water.

Polymer dispersion 2

A mixture of 20 parts (1.92 mol) of styrene, 7 parts (0.41 mol) of dimethylaminopropylmethacrylamide, 3.5 parts (0.486 mol) of acrylic acid and 10 parts of acetic acid iS pumped in the course of 1 hour, with the aid of a pump, into a kettle heated to 90° C. Simultaneously and also in the course of 1 hour, 2 parts of azobisisobutyronitrile and 10 parts of acetic acid are added with the aid of another metering apparatus. The mixture is heated at 90° C. for 30 minutes and then dissolved in 180 parts of water. Thereafter, 0.01 part of iron sulfate is added, and a mixture of 32 parts of styrene and 32 parts of isobutyl acrylate is polymerized therein at 85° C. Separately therefrom, 33 parts of a 6% strength hydrogen peroxide solution is added continuously in the course of 2 hours to the prepolymer. After further polymerization for 1 hour at 85° C., a finely divided dispersion having a solids content of 31.4% and a particle diameter of 150–250 nm results. The dispersion is diluted to a solids content of 20% by adding water.

EXAMPLE 1

A 2.36% strength by weight aqueous suspension of a commercial cationic starch (degree of substitution 0.02) is prepared by suspending the required amount of starch in water and then adding sulfuric acid in an amount such that the pH is 2.5. Thereafter, the starch suspension is heated to 95° C. in the course of 1 hour, the reaction mixture is stirred for 1 hour at this temperature and the resulting aqueous solution is allowed to cool.

10 parts of the polymer dispersion 1 are added to 90 parts of the 2.36% strength aqueous starch suspension described above, which is at 85° C. This mixture is stirred for 10 minutes at 85° C.

6 parts of a stearyldiketene melt heated to 90° C. are added to 94 parts of this mixture of starch and polymer dispersion 1, and the mixture is treated for 3 minutes with a Turrax. Thereafter, the emulsion is homogenized twice in a Lab 100 at 70° C. and 150 bar and then cooled to room temperature. A stable, 6% strength aqueous stearyldiketene emulsion which also contains 2% of starch and 3.1% of polymer dispersion 1 is obtained. The size mixture is still stable after storage for 30 days at 25° C. Creaming or solidification is not observed.

COMPARATIVE EXAMPLE 1

Example 1 was repeated, except that polymer dispersion 1 is replaced with an adipic acid/diethylenetriamine condensate which is a known promoter for alkyldiketene and which is grafted with ethyleneimine and has been reacted with a bifunctional crosslinking agent obtainable by reacting epichlorohydrin with polyethyleneglycol containing 34 ethylene oxide units.

6 parts of a stearyldiketene melt heated to 90° C. are then added to 94 parts of this starch/promoter mixture. A stable, 6% strength aqueous emulsion of stearyldiketene is obtained. The size mixtures according to Example 1 and Comparative Example 1 are each tested with regard to their sizing effect using the paper stock model described above. The amount of size added, calculated as solids, is 2% in each case, based on dry paper stock. The results shown in Table 1 are obtained.

EXAMPLE 2

Example 1 was repeated, except that a 2.66% strength aqueous suspension of a commercial cationic starch (degree of substitution 0.02) is prepared, 20 parts of polymer dispersion 1 are added to 80 parts of the 2.66% strength aqueous starch suspension described above and the mixture is stirred for 10 minutes at 85° C. The starch is then digested.

6 parts of a stearyldiketene melt heated to 90° C. are then added to 94 parts of this mixture of digested starch and polymer dispersion 1. A stable, 6% strength aqueous emulsion of stearyldiketene which, in addition to stearyldiketene, contains 2% of starch and 6.2% of polymer dispersion 1, based in each case on solids, is obtained. The emulsion is still stable after storage for 30 days at 25° C. No creaming or solidification of the size mixture is observed.

The efficiency of this size mixture is tested on the above-mentioned stock model. The results are shown in Table 1. Compared with the prior art, substantially improved immediate sizing is obtained with the same final sizing.

TABLE 1

| size prepared according to | Immediate sizing [Cobb] | Final sizing [Cobb] | Whiteness of the paper |
|---|---|---|---|
| Example 1 | 110 | 27 | 80.2 |
| Comp. Example 1 | 120 | 27 | 78.6 |
| Example 2 | 65 | 27 | 79.8 |

EXAMPLE 3

Example 1 was repeated, except that a 5.13% strength aqueous suspension of a commercial cationic starch (degree of substitution 0.02) is prepared, 50 parts of polymer dispersion 1 are added to 50 parts of this suspension and the starch is digested by heating for 10 minutes at 85° C. in the mixture with polymer dispersion 1.

A melt consisting of 20 parts of stearyldiketene and 2 parts of oleyl stearate and heated to 90° C. is added to 78 parts of the mixture of the digested starch and the polymer dispersion (1), and the mixture is then homogenized as described in Example 1. A stable, 20% strength aqueous stearyldiketene emulsion which, in addition to stearyldiketene, contains 2% of starch, 2% of oleyl stearate as a stabilizer and 12.9% of polymer dispersion 1 is obtained. The emulsion is still stable after storage for 30 days at 25° C. No creaming or solidification is observed within this time. The efficiency of this paper size mixture is tested using the abovementioned stock model. The results are shown in Table 2.

COMPARATIVE EXAMPLE 2

78 parts of a 2.5% strength aqueous solution of a digested commercial cationic starch (degree of substitution 0.02) is heated to 85° C. and a melt consisting of 20 parts of stearyldiketene and 2 parts of oleyl stearate and heated to 90° C. is added and is emulsified therein as described in Example 1. The resulting dispersion and the paper size mixture prepared according to Example 3 are then tested with regard to their efficiency, using the abovementioned paper stock. When 0.5%, based on dry paper stock, of solid is added, the values shown in Table 2 are obtained.

EXAMPLE 4

Example 1 is repeated, except that a 5.13% strength aqueous suspension of a commercial cationic starch (degree of substitution 0.02) is prepared and is mixed with 50 parts of the polymer dispersion 2, and the starch is digested by heating the mixture at 85° C. for a total of 10 minutes. A melt consisting of 20 parts of stearyldiketene and 2 parts of oleyl stearate and heated to 90° C. is then added to 78 parts of the resulting mixture of digested starch and polymer dispersion 2, and the melt is emulsified therein as described in Example 1. A stable 20% strength aqueous stearyldiketene emulsion which, in addition to stearyldiketene, also contains 2% of starch, 2% of oleyl stearate and 7.8% of polymer dispersion 2 is obtained. The paper size mixture is still stable after storage for 30 days at 35° C. During this time, it did not become solid or cream. The final sizing achievable therewith is shown in Table 2.

COMPARATIVE EXAMPLE 3

78 parts of 2.56% strength aqueous solution of a digested commercial cationic starch (degree of substitution 0.02) is heated to 85° C. and, at this temperature, is combined with a melt of 20 parts of stearyldiketene and 2 parts of oleyl stearate by the method stated in Example 1 and is thus emulsified. The size mixture thus obtained is tested with regard to its efficiency using the stock model described above. 0.5%, based on dry paper stock, of the size is used. The value for the resulting final sizing is shown in Table 2. As is evident therefrom, the final liming when the size mixture according to Example 4 is used is substantially higher than the sizing obtainable with the agent according to Comparative Example 3.

TABLE 2

| Size prepared according to | | Final sizing |
|---|---|---|
| Example | Comparative Example | [Cobb] |
| 3 | — | 35 |
| — | 2 | 62 |
| 4 | — | 31 |
| — | 3 | 62 |

We claim:

1. A paper size mixture which is prepared by mixing an aqueous suspension of a digested cationic starch with a finely divided, aqueous 0.5–5% strength by weight polymer dispersion which is a paper size and emulsifying a $C_{14}$–$C_{22}$-alkyldiketene in this mixture at not less than 70° C.

2. A paper size mixture as claimed in claim 1, wherein emulsification of the $C_{14}$–$C_{22}$-alkyldiketene is additionally effected in the presence of fatty esters and urethanes which are stabilizers for alkyldiketene emulsions.

3. A paper size mixture as claimed in claim 1 or 2, wherein polymer dispersion obtainable by copolymerizing (a) from 20 to 65% by weight of styrene, acrylonitrile or methacrylonitrile, (b) from 80 to 35% by weight of an acrylate or methacrylate of a monohydric saturated $C_3$–$C_8$-alcohol and (c) from 0 to 10% by weight of other monoethylenically unsaturated copolymerizable monomers in the presence of a free radical initiator by an emulsion polymerization method in an aqueous solution of a degraded starch as a protective colloid is used as the polymer dispersion which is the paper size.

4. A paper size mixture as claimed in claim 1 or 2, wherein a polymer dispersion which is obtainable by copolymerizing from 1 to 32 parts by weight of a mixture of (a) styrene, acrylonitrile or methacrylonitrile and (b) an acrylate or methacrylate of $C_1$–$C_{18}$-alcohols or a vinyl ester of a saturated $C_2$–$C_4$-carboxylic acid, with or without (c) other monoethylenically unsaturated copolymerizable monomers in aqueous solution in the presence of 1 part by weight of a solution copolymer of (1) a di-$C_1$–$C_4$-alkylamino-$C_2$–$C_4$-alkyl (meth)acrylate which may be protonated or quaternized and (2) nonionic, hydrophobic, ethylenically unsaturated monomers which, when polymerized alone, form hydrophobic polymers, with or without (3) a monoethylenically unsaturated $C_3$–$C_5$-carboxylic acid or an anhydride thereof, the molar ratio of (1):(2):(3) being 1:2.5–10:0–1.5, is used as the polymer dispersion which is the paper size.

5. A method for engine or surface sizing a paper, comprising applying to said paper a paper size mixture as claimed in any of claims 1 to 4.

* * * * *